US009443670B2

(12) United States Patent
Osvatic et al.

(10) Patent No.: US 9,443,670 B2
(45) Date of Patent: Sep. 13, 2016

(54) CONTAMINATION RESISTANT PUSH BUTTON SWITCH

(71) Applicant: Illinois Tool Works Inc., Glenview, IL (US)

(72) Inventors: Michael S. Osvatic, Waukesha, WI (US); Jarod M. Sulik, Elkhorn, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 222 days.

(21) Appl. No.: 13/861,859

(22) Filed: Apr. 12, 2013

(65) Prior Publication Data

US 2014/0124342 A1 May 8, 2014

Related U.S. Application Data

(60) Provisional application No. 61/655,727, filed on Jun. 5, 2012.

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/04*** | (2006.01) |
| ***H01H 13/18*** | (2006.01) |
| *H01H 3/42* | (2006.01) |
| *H01H 5/06* | (2006.01) |

(52) U.S. Cl.

CPC ..... *H01H 9/047* (2013.01); *H01H 13/183* (2013.01); *H01H 3/42* (2013.01); *H01H 5/06* (2013.01); *H01H 2223/004* (2013.01)

(58) Field of Classification Search

CPC ..... H01H 13/14; H01H 9/04; H01H 3/20; H01H 13/06; H01H 3/46; H01H 15/00

USPC ..... 200/293, 520, 341, 302.2, 345, 344

See application file for complete search history.

(56) References Cited

U.S. PATENT DOCUMENTS

| | | | | |
|---|---|---|---|---|
| 4,454,397 | A * | 6/1984 | Kim | 200/296 |
| 6,605,792 | B2 * | 8/2003 | Sato | 200/524 |
| 6,903,283 | B2 * | 6/2005 | Skarlupka et al. | 200/16 B |
| 7,154,058 | B2 * | 12/2006 | Kim et al. | 200/302.1 |
| 7,579,567 | B2 * | 8/2009 | Lee | H01H 13/14 200/341 |
| 2012/0103774 | A1 * | 5/2012 | Jun | 200/345 |
| 2013/0327622 | A1 * | 12/2013 | Fang et al. | 200/293 |

* cited by examiner

*Primary Examiner* — Renee Luebke
*Assistant Examiner* — Lheiren Mae A Caroc
(74) *Attorney, Agent, or Firm* — Boyle Fredrickson, S.C.

(57) ABSTRACT

A switch suitable for use in contaminated environments provides for internal support of the operator allowing an oversized opening in the housing of the switch through which the operator extends. In this way contamination on the outer surface of the operator may be accommodated without a jamming of the operator in the retracted position.

16 Claims, 4 Drawing Sheets

CONTAMINATION RESISTANT PUSH BUTTON SWITCH

CROSS-REFERENCE TO RELATED APPLICATIONS

This application is based on U.S. provisional application 61/655,727 filed Jun. 5, 2012 and hereby incorporated by reference.

FIELD OF THE INVENTION

The present invention relates to an electrical switch having a pushbutton operator that is resistant to contamination that would cause sticking of the pushbutton in an activated position.

BACKGROUND OF THE INVENTION

Modern appliances such as frontloading washing machines or dryers may provide for lid or door switches detecting when the appliance lid or door is open. These lid switches turn off the appliance to allow the user unhampered access to the clothing in the machine and to protect the consumer from machinery moving inside the appliance. Such switches may provide a button or "switch operator" extending from the housing of the appliance to be activated by closing of the door, the latter which presses the button inward into the housing.

The switch operator may slide within a sleeve that provides for mechanical support to the switch operator guiding it in axial translation when the switch operator is pressed by the door. The sleeve may conform closely to an outer surface of the switch operator both to prevent the ingress of contaminants into the housing and to prevent camming or jamming of the switch operator as it is pressed inward by the door. The sleeve may be stationary with respect to the housing and therefore sealed to the housing.

Contaminants such as water, bleach, fabric softener and detergent that are blocked by the close fit between the sleeve and the switch operator may nevertheless accumulate and dry on the outer surface of the switch operator that protrudes from the housing when the door is open. Such contaminants can cause the switch operator to jam within the sleeve when it is retracted therein potentially allowing operation of the appliance even when the door is open.

SUMMARY OF THE INVENTION

The present invention provides a pushbutton switch operator assembly that better resists contamination in the laundry environment or the like by providing a support for the switch operator that is removed from the opening through which the switch operator extends. In this way, the opening through which the switch operator expands may be enlarged so that contamination building up on the switch operator does not interfere with the switch operator movement. Contamination entering through this opening may be diverted in a safe drain passage out of the housing of the switch and/or may be blocked when the switch is fully extended by a rearward collar on the switch operator.

Specifically, then, the present invention provides, in one embodiment, an electrical switch having: a housing providing an opening therein, electrical contacts held within the housing, and a switch operator shaft communicating with the electrical contacts for opening and closing the electrical contacts. The switch operator is supported by a support structure positioned within the housing allowing the switch operator to move along an axis to project through the opening in the housing in an extended state and to retract at least in part into the housing in a retracted state. The support structure is removed from the opening, the latter of which provides substantially no support of the switch operator shaft. The switch operator shaft has a first radial extent about the axis smaller than the opening in the housing so that there is substantially no contact between the switch operator shaft and the opening in the housing when the switch operator shaft is in a retracted position.

It is thus a feature of at least one embodiment of the invention to provide a switch with an operator that is more resistant to contamination of the outer operator surface. By moving the support structure away from this outer surface, interference between the outer surface and a supporting escutcheon opening is reduced.

The housing may include a drain port for conducting liquid carried from outside the housing along the switch operator shaft into the housing out of the housing along the drainage path removed from the contacts.

It is thus a feature of at least one embodiment of the invention to accommodate some ingress of contamination when the switch operator is fully retracted.

The electrical contacts may communicate with the switch operator by means of a lever having a first cam surface interacting with the switch operator to pivot the lever with axial movement of the switch operator and wherein the lever extends in a direction substantially perpendicular to the axis and the drainage path.

It is thus a feature of at least one embodiment of the invention to offset the electrical components of the switch outside of the natural drainage of contamination of the switch operator.

The switch operator shaft may include an axial bore and the support structure may be a pillar extending along the axis and fitting slidably within the axial bore.

It is thus a feature of at least one embodiment of the invention to shield the support structure within the switch operator to better resist contamination.

The pillar may include a central bore receiving a helical compression spring extending between a bottom of the central bore of the pillar and a top of the axial bore of the switch operator shaft to urge the switch operator shaft toward the extended state.

It is thus a feature of at least one embodiment of the invention to provide a spring-biasing of the switch operator that is both resistant to contamination and centered along an axis of movement of the switch operator to reduce camming.

The invention may include a key element on the switch operator shaft for resisting rotation of the switch operator shaft about the axis during movement between the extended and retracted state.

It is thus a feature of at least one embodiment of the invention to allow reliable intercommunication between the switch operator and the contacts such as may otherwise be disturbed by rotation of the switch operator.

The key element may be a radially extending finger fitting within a channel parallel to the axis and fixed with respect to the housing. In one example, the key element may extend radially outward and the channel is outside of the switch operator shaft.

It is thus a feature of at least one embodiment of the invention to provide a simple method of preventing rotation of the switch operator that may employ an arbitrarily long lever to be removed from contamination or the need for close tolerances.

Alternatively the key element may radially extend inward and the channel is a portion of the pillar.

It is thus a feature of at least one embodiment of the invention to provide a key element that is largely shielded from the possibility of contamination The electrical switch may include a shaft collar extending radially about the axis from a rear end of the switch operator shaft and having a radial extent larger than the radial extent of the switch operator shaft and substantially equal to the opening in the housing to obstruct the opening in the housing when the switch operator shaft is in the extended state.

It is thus a feature of at least one embodiment of the invention to provide a mechanism for blocking ingress of contamination, for example when the washing machine or dryer door is open and the switch is most subject to contamination, and to provide a trip ledge for truncating inflow of contamination along the switch operator held by capillary attraction.

The electrical contacts may be closed when the switch operator is in the retracted state.

It is thus a feature of at least one embodiment of the invention to provide for an open state of at least one pair of contacts (for example that may control the activation of internal machinery) when the switch operator is in the extended state most susceptible to jamming.

Other features and advantages of the invention will become apparent to those skilled in the art upon review of the following detailed description, claims and drawings in which like numerals are used to designate like features.

Figure 1:
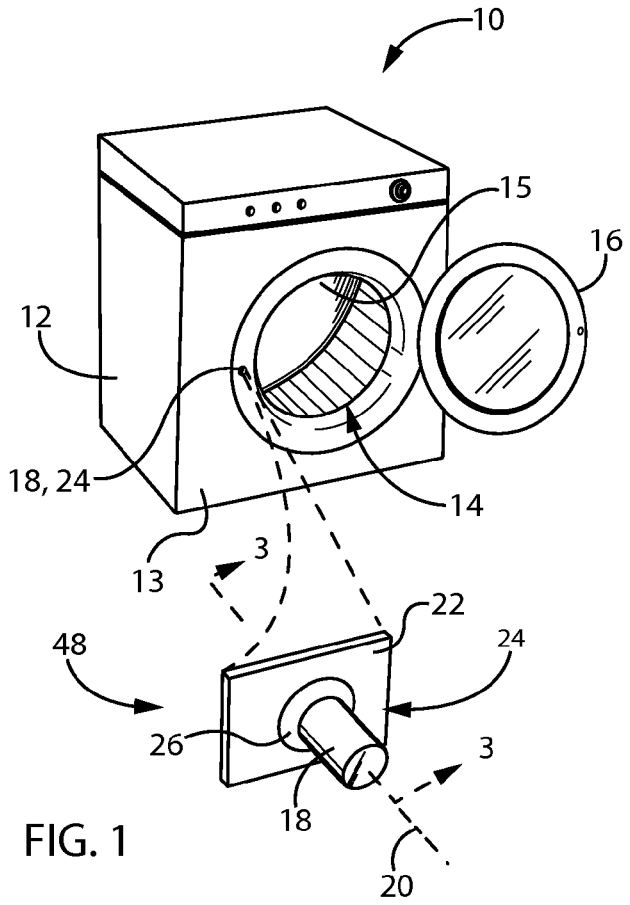
FIG. 1 is a perspective view of a front-loading washing machine suitable for use with the present invention showing an enlarged detail of a switch operator extending from a housing of the appliance.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an appliance 10, for example a front-loading washing machine, may provide for a housing 12 having an opening 14 in a front wall 13 for providing a user access to a washing volume 15 of a type well known in the art. The opening 14 may be coverable by a door 16 that may seal against the opening 14 to block the flow of water therethrough. While a washing machine is shown in the following example, the invention may also be used in other appliances subject to contamination including dryers, these appliances referred to herein, generally, as laundry machines.

The door 16 may hinge, for example, about a vertical axis at one edge of the door 16 to a side of the opening 14 so that the opposite edge of the door 16 may swing inwards covering the opening 14 and pressing inward on a switch operator 18 protruding from that opposite edge. The pressing inward of the switch operator 18 provides an electrical signal to a control system of the appliance 10 indicating closure of the door 16 and normally allowing activation of internal mechanisms such as a spin basket/agitator, water valves and the like.

In one embodiment, the switch operator 18 may present a button providing a substantially cylindrical outer surface axially aligned with the horizontal axis 20 and movable along the horizontal axis 20 generally perpendicular to a front face of the appliance.

The switch operator 18 may extend through a front faceplate 22 being an integral or connectable part of the switch 48 associated with the switch operator 18, for example, providing an escutcheon that seals against the housing 12. An opening 24 in the faceplate 22 through which the switch operator 18 extends is sized to be larger than the radius circumscribing the extending portion of the switch operator 18 (being the radius of the cylinder of the switch operator 18 when it is cylindrical). This opening 24 is nevertheless filled when the switch operator 18 is fully extended (as shown in FIG. 1) by a collar 26 extending radially outward near a rear edge of the switch operator 18 (closest to the housing 12) and integrally formed with the remainder of the switch operator 18, for example, as a thermoplastic injection molded part. This collar 26 may be circular or other shape conforming to the opening 24. Alternatively, the collar 26 may be a rearward flaring on the switch operator 18.

Figure 2:
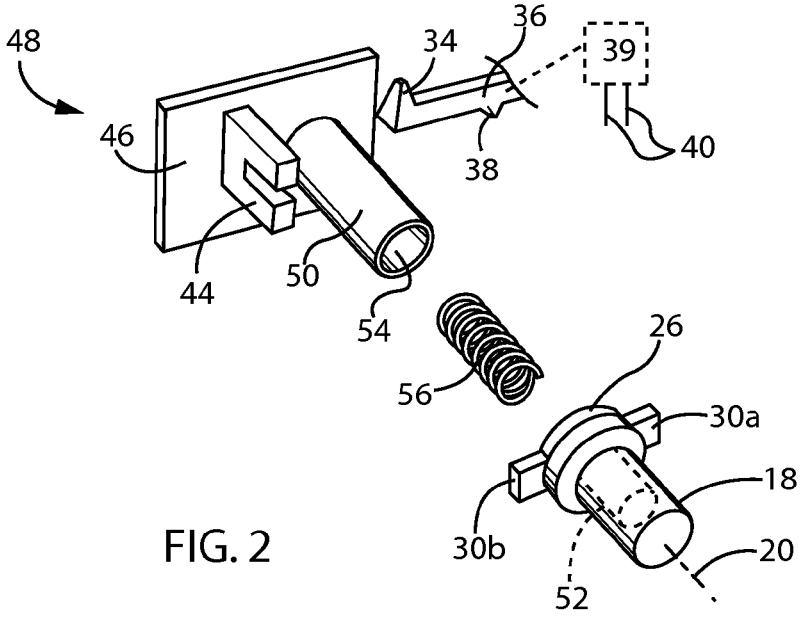
FIG. 2 is an exploded diagram of the switch operator as supported by an internal pillar and biased by a helical compression spring showing a rearward flaring of the switch operator to provide sealing, and a drip ring and sideably extending tabs that stabilize the switch operator against rotation, limit outward travel of the switch operator and activate an internal switch mechanism.

Referring now to FIG. 2, a rear edge of the switch operator 18 behind the radially extending collar 26 may include side tabs 30*a* and 30*b* extending from the switch operator perpendicularly to the axis 20 on either side of the axis 20. The tab 30*a* may engage with a cam surface 34 to move a rocker arm 36 about a fulcrum 38 when the switch operator 18 is pressed inward. The rocker arm 36 communicates with electrical contacts 39 of a type known in the art to provide a switching of electrical current through switch leads 40. More specifically, at least two contacts 39 of the switch 48 may contact when the switch operator 18 is fully depressed, for example, to allow current flow to an appliance motor (not shown) when the door 16 is closed. Conversely, the two contacts 39 may be separated when the switch operator 18 is fully extended to break current flow to the appliance motor.

The remaining and opposite tab 30*b* may be received by a guide slot 44, for example, formed in a housing 46 of the switch 48. Engagement between the tabs 30*b* and guide slot 44 over the full extension range of the switch operator 18 helps prevent rotation of the switch operator 18 and ensures proper alignment of the tab 30*a* and the cam surface 34. The tabs 30*a* and 30*b* may also limit the outward travel of the switch operator 18 by extending beyond the collar 26 to abut a rear surface of opening 24 as the switch operator 18 moves outward.

A guide pillar 50 may extend forward along axis 20 from a portion of the housing 46 adjacent to the guide slot 44 and have an outer diameter that may fit within an axial bore 52 formed coaxially within the switch operator 18 and opening rearwardly therefrom. The interface between the pillar 50 and the bore 52 provides the axial guidance of the switch operator 18 when it is extended and retracted that would otherwise be provided by a tightly fitting outer sleeve not employed in the present invention. The pillar 50 may itself include an internal coaxial bore 54 that may receive a helical compression spring 56 fitting between the bottom of the bore 54 at one end and a top of the bore 52 in the switch operator 18 on the other end. The helical compression spring 56 operates to bias the switch operator 18 to its fully extended outward position in the absence of pressure by the door 16.

Figure 3A:
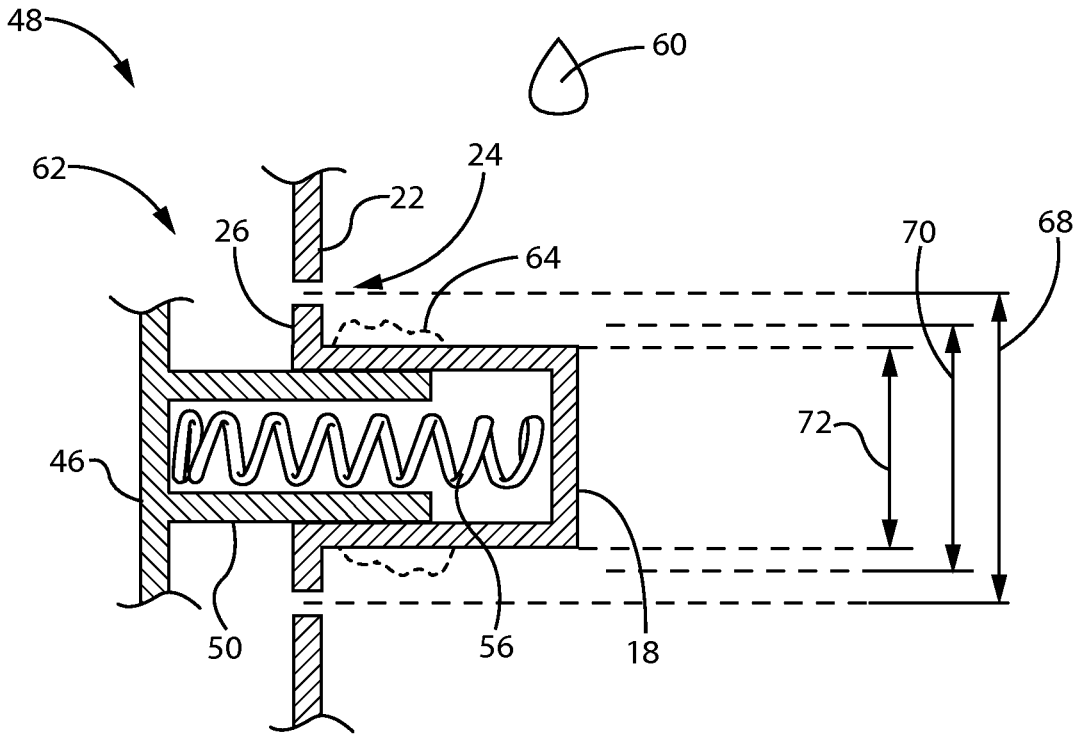
FIG. 3*a* is a cross-section taken along line 3-3 of FIG. 1 showing the switch operator in an extended position when an appliance door is open.

Referring now to FIG. 3*a*, when the switch operator 18 is in its outermost position (limited by the tabs 30*a* and 30*b* not shown in FIG. 3*a*) the collar 26 substantially fills the diameter 68 of the opening 24 to prevent contamination 60 outside of the appliance 10 from passing into the inner volume 62 of the switch 48 or inside the appliance 10.

Nevertheless contamination 60, for example bleach or other cleaning products described above, can contact the outer surface of the extended switch operator 18 and may harden in the form of crystals or the like as surface contamination 64 which increases the effective diameter 70 of the switch operator 18 beyond the actual diameter 72 of the switch operator 18. This increase in effective diameter 70 would normally cause jamming of the switch operator 18 against an outer supporting sleeve but in the present invention the effective diameter 70 will remain below the diameter 68 of the opening 24 during typical use. Contamination 60 which drips off of the switch operator 18, when the switch operator 18 is fully extended, will be guided by the lower portion of the collar 26 and the inter-fitting faceplate 22 to remain outside of the housing 12. The switch operator 18 is held, when the door 16 is open, in this fully extended position by the extension of the helical spring 56.

Figure 3B:
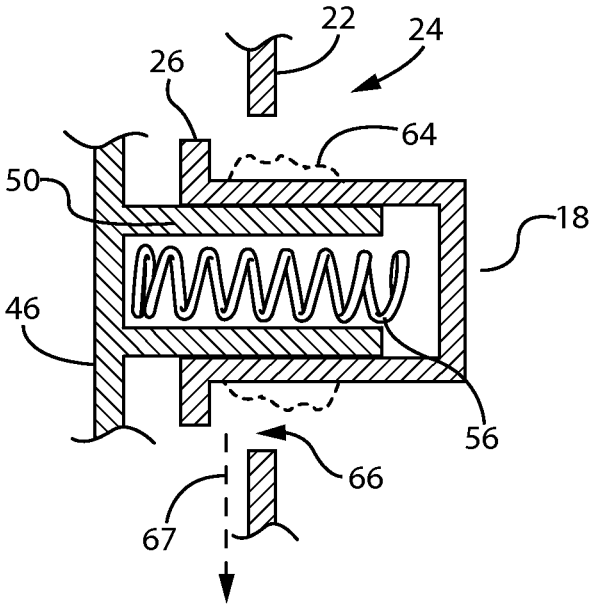
FIG. 3*b* is a figure similar to that of 3*a* showing the switch operator in a retracted position when the appliance door is closed.

Referring now to FIG. 3*b*, when the switch operator 18 is pressed inward by the door 16, the surface contamination 64 may pass easily through the opening 24 as the collar 26 moves back and the spring 56 is compressed. Contamination 60 on the switch operator 18 or otherwise introduced through the opening 24 at this point in time may wick along the under surface of the switch operator 18 but will be prevented from entering the low clearance space between the pillar 50 and the inner bore of the switch operator 18 by the action of the collar 26 which forms a drip ring conducting any such liquid to a lower point 66 away from this interface and along a drain path 67 leading out of the housing 46.

Figure 6:
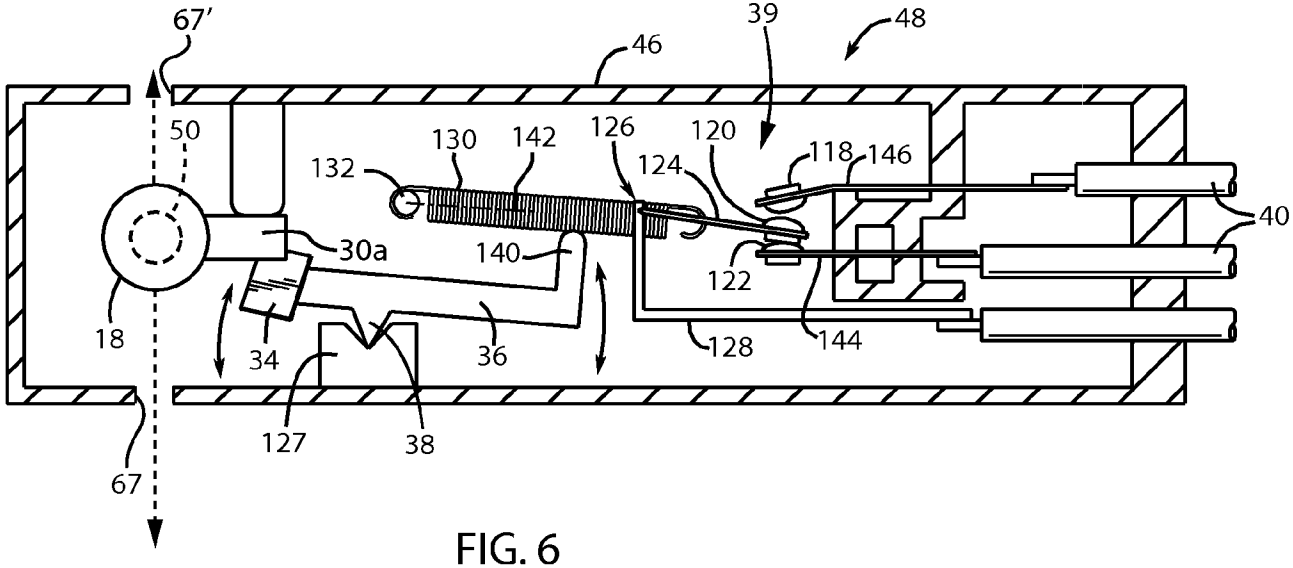
FIG. 6 is an elevational cross-section along line 2-2 in FIG. 1 showing a mechanical linkage between the switch operator and an over-center spring mechanism for moving a center contact between two outer flanking contacts each connected to different of the conductors of FIG. 2, where the lower flanking contact is mounted to be substantially stationary and the upper flanking contact is mounted on a flexible support arm, the switch being shown in a first "safe" state with the switch operator released.

Referring momentarily to FIGS. 1 and 6, symmetric drain paths 67 and 67' are placed on opposite sides of the housing 46 to allow the housing 46 to be mounted to the appliance 10 in either of two orientations so that one of the drain paths 67, 67' is directed downward.

Figure 4:
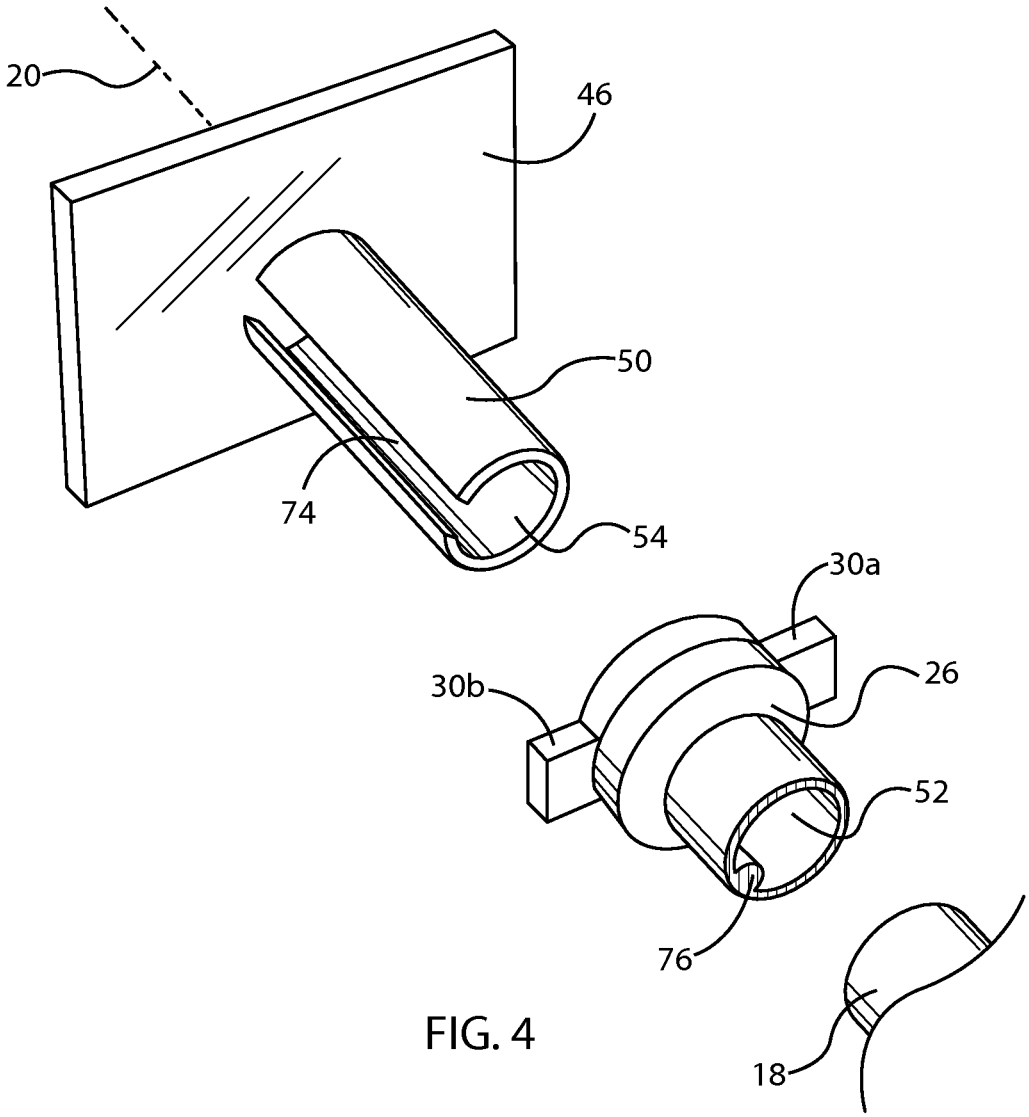
FIG. 4 is a figure similar to FIG. 2 showing an internal slot stabilizing the switch against rotation.

Referring now to FIG. 4, in an alternative embodiment or in conjunction with the embodiment of FIG. 2, the pillar 50 may have a side slot 74 running along axis 20 to give the pillar 50 a C-shaped cross-section. An internal tooth 76 within the bore 52 of the switch operator 18 may slide along the slot 74 to prevent rotation of the switch operator 18 with axial movement of the switch operator 18 in the same manner as the guide slot 44 while allowing elimination of the guide slot 44.

It will be appreciated that any contamination that collects between the collar 26 and the opening 24, for example, when the switch operator is fully extended as shown in FIG. 3*a*, will be broken by movement of the switch operator 18 inward by closing of the door 16 or otherwise will prevent the appliance motor from being activated thus holding the appliance 10 in a safe state.

Figure 5:
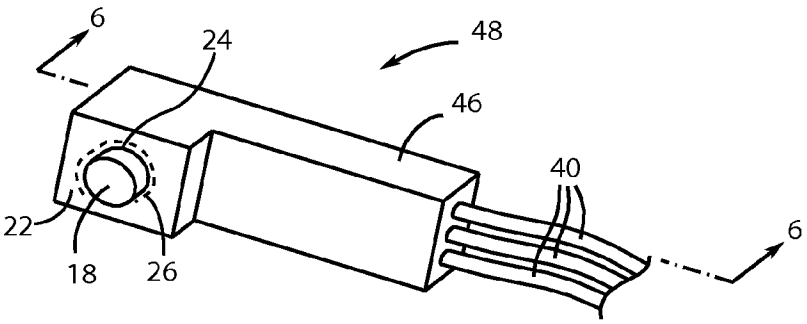
FIG. 5 is a perspective view of a switch that may incorporate the switch operator of the present invention extending therefrom for actuation of the switch and having electrical conductors for connecting the switch to other elements such as a motor of an appliance.

Referring now to FIG. 5, the housing 46 of the electrical switch 48 may be constructed of an insulating thermoplastic material molded to include the opening 24 through which the pushbutton switch operator 18 extends. Conductive leads 40 may extend through other openings in the housing 46 to communicate with external electrical circuits, for example motors or actuators of a household appliance (not shown).

Referring now to FIG. 6, the electrical switch 48 may contain an upper contact 118, a center contact 120, and a lower contact 122 arranged to provide a single pole, double throw electrical switch with the upper contact 118 and lower contact 122 generally flanking the center contact 120. The center contact 120 may move between the upper contact 118 and lower contact 120 to selectively and alternatively connect to only one of the upper contact 118 and lower contact 122.

The center contact 120 may be supported on a relatively rigid conductive lever 124 attached at a knife edge pivot point 126 to a conductive support bracket 128, the latter communicating with one of the conductive leads 40 and pivot point 126 allowing electrical conduction from the conductive lever 124 to the conductive lead 40. By pivoting the lever 124 around the pivot point 126, the lever 124 may be moved upward and downward so that the center contact 120 alternately connects electrically to upper contact 118 and lower contact 122.

A helical over-center spring 130 attaches to a center portion of the lever 124 and extends away from the center contact 120 to a support post 132 on the housing 46 to provide a force on the lever 124 tending to engage the lever 124 and support bracket 128 at the pivot point 126.

The switch operator 18, when pressed inward (into the page as depicted in FIG. 6), presses against a cam surface 34 attached at one end of a rocker arm 36 to rotate the rocker arm 36 counterclockwise about a center-positioned fulcrum 38 held on a fulcrum block 127. An opposite end of the rocker arm 36 provides an upwardly extending finger 140 which deflects a center region of the helical over-center spring 130 upward to change its line of action 142 with respect to the fulcrum 38. The line of action 142 represents a force vector asserted on the lever 124 by the helical over-center spring 130. When the line of action 42 is above the pivot point 126, the lever 124 will snap rapidly upward and when the line of action 42 is below the pivot point 126, lever 124 will snap rapidly downward.

Referring still to FIG. 6, the upper contact 118 and lower contact 122 are each generally supported on a cantilevered conductive metal strip to one of the conductive leads 40. Specifically, the upper contact 118 is supported on a lower distal end of flexible metal lever 146 and the lower contact 122 is supported on an upper distal end of a substantially rigid conductive metal strip 144. Generally the strip 144 and lever 146 extend from their respective contacts 118 and 122 in the opposite direction as the lever 124.

When the switch operator 18 is released and the rocker arm 36 rotates to its full clockwise position, the line of action 142 of the helical over-center spring 130 moves below the pivot point 126 and a lower surface of the center contact 120 contacts an upper surface of the lower contact 122 at a first position as pulled together by a torsional vector component of the force along the line of action 142 of the over-center spring 130, the force pulling downward on lever 124. An upper surface of contact 120 is separated from a lower surface of the upper contact 118 so that a circuit is "made" between contacts 121 and 122 and "broken" between contacts 121 and 118.

When the switch operator 18 is compressed, the rocker arm 36 rotates to a full counterclockwise position pressing upward on the helical over-center spring 130 to move the line of action 142 above the pivot point 126 pulling upward on lever 124 so that an upper surface of contact 122 contacts the lower surface of contact 118 at a second position. Under the force of contact 122, flexible lever 146 is moved upward allowing the lever 146 to straighten as it rotates to break any microscopic welds.

Various of the components of the switch 48 as described above are the subject of co-pending application publication number 2013/0015049 published Jan. 17, 2013 and hereby incorporated in its entirety by reference.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An electrical switch comprising:

a housing providing an opening therein;

electrical contacts held within the housing and communicating with conductors extending from the electrical contacts through the housing to connect to an external device;

a switch operator shaft communicating with the electrical contacts for opening and closing the electrical contacts;

a support structure positioned within the housing supporting the switch operator shaft with respect to the housing to be movable along an axis to project through the opening in the housing in an extended state and to retract at least in part into the housing in a retracted state, the support structure removed from the opening, the latter of which provides no support of the switch operator shaft;

wherein the switch operator shaft has an outwardly exposed first radial extent about the axis smaller than the opening in the housing and that passes through the opening with movement of the switch operator shaft so that there is no contact between radially outer exposed surfaces of the switch operator shaft and either of the opening in the housing or other structure stationary with respect to the housing, when the switch operator shaft is in a retracted position and wherein a rear end of the switch operator shaft provides a radially extending collar of diameter greater than the first radial extent about the axis, the collar positioned within the opening and substantially filling the diameter of the opening when the switch operator shaft is in a fully extended position and retracting inside the housing, not filling the opening when the operator shaft is in the retracted position; wherein all radial outer surfaces of the switch operator shaft including the collar are removed from contact with the opening or other structure stationary with respect to the housing when the switch operator shaft is in the retracted position; and wherein the switch operator shaft includes an axial bore and wherein the support structure is a pillar extending along the axis and fitting slidably within the axial bore.

2. The electrical switch of claim 1 wherein the housing includes a drain port for conducting liquid carried from outside the housing along the switch operator shaft into the housing then out of the housing along a drainage path removed from the contacts and the opening.

3. The electrical switch of claim 2 wherein the electrical contacts communicate with the switch operator shaft by means of a lever having a first cam surface interacting with the switch operator shaft to pivot the lever with axial movement of the switch operator and wherein the lever extends in a direction substantially perpendicular to the axis and the drainage path.

4. The electrical switch of claim 1 wherein the pillar includes a central bore receiving a helical compression spring extending between a bottom of the central bore of the pillar and a top of the axial bore of the switch operator shaft to urge the switch operator shaft toward the extended state.

5. The electrical switch of claim 1 further including a key element on the switch operator shaft for resisting rotation of the switch operator shaft about the axis during movement between the extended and retracted state.

6. The electrical switch of claim 5 wherein the key element is a radially extending finger fitting within a channel parallel to the axis and fixed with respect to the housing.

7. The electrical switch of claim 6 wherein the key element extends radially outward and the channel is outside of the switch operator shaft.

8. The electrical switch of claim 1 wherein the electrical contacts are closed when the switch operator is in the retracted state.

9. Electrical switch of claim 1 wherein the collar provides a drip ring preventing liquid carried from outside the housing along the switch operator from moving beyond the collar and contacting any structure stationary with respect to the housing while being carried along the switch operator when the switch operator extends substantially horizontally.

10. An electrical switch comprising:

a housing providing an opening therein;

electrical contacts held within the housing and communicating with conductors extending from the electrical contacts through the housing to connect to an external device;

a switch operator shaft communicating with the electrical contacts for opening and closing the electrical contacts;

a support structure positioned within the housing supporting the switch operator shaft with respect to the housing to be movable along an axis to project through the opening in the housing in an extended state and to retract at least in part into the housing in a retracted state, the support structure removed from the opening, the latter of which provides substantially no support of the switch operator shaft;

wherein the switch operator shaft has an outwardly exposed first radial extent about the axis smaller than the opening in the housing so that there is no contact between the outwardly exposed first radial extent of the switch operator shaft and the opening in either of the housing or other structure stationary with respect to the housing when the switch operator shaft is in a retracted position;

further including a key element, on the switch operator shaft for resisting rotation of the switch operator shaft about the axis during movement between the extended and retracted state;

wherein the key element is a radially extending finger fitting within a channel parallel to the axis and fixed with respect to the housing; and wherein the switch operator shaft includes an axial bore and wherein the support structure is a pillar extending along the axis and fitting slidably within the axial bore and wherein the key element extends radially inward and the channel is a portion of the pillar.

11. A laundry machine of a type having a volume for receiving clothing, the volume accessible through a front substantially vertical wall of the machine coverable by a door sealing the volume when closed and including an electrical switch comprising:

a housing providing an opening therein;

electrical contacts held within the housing and communicating with conductors extending from the electrical contacts through the housing to connect to an external device;

a switch operator shaft communicating with the electrical contacts for opening and closing the electrical contacts;

a support structure positioned within the housing supporting the switch operator shaft with respect to the housing to be movable along an axis to project through the opening in the housing in an extended state and to retract at least in part into the housing in a second retracted state, the support structure removed from the opening, and the interface between the opening and the switch operator shall providing no support of the switch operator shaft;

wherein the switch operator shaft has an outwardly exposed first radial extent about the axis smaller than the opening in the housing and that passes through the opening with movement of the switch operator shaft so that there is no contact between radially outer exposed surfaces of the switch operator shaft and either of the opening in the housing or other structure stationary with respect to the housing when the switch operator shaft is in a retracted position and wherein a rear end of the switch operator shaft provides a radially extending collar of diameter greater than the first radial extent about the axis, the collar positioned within the opening and substantially filling the diameter of the opening when the switch operator shaft is in a fully extended position and retracting inside the housing, not filling the opening when the operator shaft is in the retracted position; wherein all radial outer surfaces of the switch operator shaft including the collar are removed from contact with the opening or other structure stationary with respect to the housing the switch operator shaft is in the retracted position;

wherein the housing is attached to the front wall of the laundry machine so that the axis of the switch operator shaft is substantially horizontal and so that the switch operator shaft is compressed by closing of the door from the extended position to the retracted position; and wherein the switch operator shaft includes an axial bore and wherein the support structure is a pillar extending along the axis and fitting slidably within the axial bore.

12. The laundry machine of claim 11 wherein the housing includes a drain port for conducting liquid carried from outside the housing along the switch operator shaft into the housing, then out of the housing along a drainage path removed from the contacts.

13. The laundry machine of claim 12 wherein the electrical contacts communicate with the switch operator by means of a lever having a first cam surface interacting with the switch operator to pivot the lever with axial movement of the switch operator and wherein the lever extends in a direction substantially perpendicular to the axis and the drainage path.

14. The laundry machine of claim 11 wherein the pillar includes a central bore receiving a helical compression spring extending between a bottom of the central bore of the pillar and a top of the axial bore of the switch operator shaft to urge the switch operator shaft toward the extended state.

15. The laundry machine of claim 11 further including a key element on the switch operator shaft for resisting rotation of the switch operator shaft about the axis during movement between the extended and retracted state.

16. The electrical switch of claim 9 wherein the housing includes a drain port for conducting liquid carried from outside the housing along the switch operator shaft into the housing when that liquid, drips from the collar when the switch operator is in the retracted position, out of the housing along a drainage path removed from the contacts and the opening.

* * * * *